United States Patent [19]

Shinoda

[11] 4,181,104

[45] Jan. 1, 1980

[54] IDLE SPEED CONTROLLER FOR INTERNAL COMBUSTION ENGINES

[75] Inventor: Kazuo Shinoda, Toyota, Japan

[73] Assignee: Toyota Jidosha Kogyo Kabushiki Kaisha, Toyota, Japan

[21] Appl. No.: 810,873

[22] Filed: Jun. 28, 1977

[30] Foreign Application Priority Data

Mar. 15, 1977 [JP] Japan ..... 52-28500

[51] Int. Cl.[2] ..... F02M 1/00; F02M 3/08

[52] U.S. Cl. ..... 123/102; 123/97 B; 123/103 R; 123/103 E; 123/179 G

[58] Field of Search ..... 123/102, 103 R, 103 E, 123/119 EC, 32 EA, 97 B, 179 G; 180/105 E

[56] References Cited

U.S. PATENT DOCUMENTS

| | | | |
|---|---|---|---|
| 3,070,185 | 12/1962 | Fales | 123/102 |
| 3,332,406 | 7/1967 | Perry et al. | 123/102 |
| 3,405,779 | 10/1968 | Johnston | 123/102 |
| 3,612,009 | 10/1971 | Kamazuka et al. | 123/32 EA |
| 3,722,614 | 3/1973 | Sakakibara et al. | 123/102 |
| 3,804,193 | 4/1974 | Ikuta | 123/102 |
| 3,809,034 | 5/1974 | Durichen | 123/103 R |
| 3,895,684 | 7/1975 | Takeshi et al. | 123/102 |
| 3,964,457 | 6/1976 | Coscia | 123/32 EA |
| 4,051,823 | 10/1977 | Mogi et al. | 123/97 B |
| 4,075,983 | 2/1978 | Robinson | 123/102 |
| 4,086,888 | 5/1978 | Roberts | 180/105 E |

*Primary Examiner*—Charles J. Myhre
*Assistant Examiner*—Andrew M. Dolinar
*Attorney, Agent, or Firm*—Stevens, Davis, Miller & Mosher

[57] ABSTRACT

An idle speed controller for internal combustion engines, having an adjustable idle positioner, an actuator for setting the idle positioner and a control means for operating the actuator, the control means being adapted to generate an output signal depending upon an input signal representing engine speed so as to accomplish a feedback control of engine idling speed.

3 Claims, 9 Drawing Figures

IDLE SPEED CONTROLLER FOR INTERNAL COMBUSTION ENGINES

BACKGROUND OF THE INVENTION

The present invention relates to an idle speed controller for an internal combustion engine for automobiles.

An internal combustion engine for automobiles has a throttle valve incorporated in an intake air passage thereof for controlling the amount of intake air thereby controlling output power and rotational speed of the engine. In an engine having a carburetor, the throttle valve is usually incorporated in the carburetor. The throttle valve is adapted to be opened or closed by operation of an accelerator pedal performed by the driver and when the accelerator pedal is released, the throttle valve is automatically driven towards a substantially closed idling position determined by an idle positioner. The conventional idle positioner generally comprises a set of co-operating abutting means, one being supported by a throttle lever for rotationally driving the throttle valve by engaging a throttle shaft which supports the throttle valve while the other abutting member is supported by a stationary structure such as the body of the carburetor. In this case, one of the two co-operating abutting members generally incorporates screw means therein for adjusting the abutting relation therebetween so as to allow the idling opening of the throttle valve to be adjusted by turning the screw means. In the conventional throttle positioner having this structure, the adjustment of the idling position is fixedly maintained or, in other words, no occasional re-adjustment of the idle position in accordance with changes in the operational conditions of the engine is automatically available or is manually available from the driver's seat.

However, in automobiles, particularly modern automobiles equipped with various auxiliary devices such as automatic transmission, power steering, air-conditioning, etc., the load imposed on the engine in idling operation varies by a large amount in accordance with the temperature condition of the engine and the ambient temperature. Therefore, when the idle position is fixedly adjusted by the conventional throttle positioner, the minimum throttle opening or idle opening must be set at a relatively large opening so as to ensure stable rotation of the engine in the highest idling load condition. However, such an adjustment causes too high idling rotation of the engine when the idling engine load is low as in the idling operation wherein the engine is sufficiently warmed up and the air conditioner is not used. Idling operation at too high rotational speed is very undesirable in view of the engine noise and fuel consumption.

Conventionally, engines generally incorporate a fast idle means adapted to operate in relation to a choke valve in the carburetor in order to facilitate cold-start-up of the engine. The fast idle means incorporates a bimetallic means and is adapted to increase the idle opening of the throttle valve when the engine is in cold state so as to increase the idling rotational speed thereby compensating for an increased idling load due to higher viscosity of lubricating oil in cold state and accelerating warming up of the engine. The conventional fast idling means is generally adapted to maintain the increased idle opening even after the engine has been warmed up if the throttle valve is not opened by stepping on the accelerator pedal in the course of warming up operation because although the bimetallic means responds to the warming up of the engine, a resetting of the idling position due to deformation of the bimetallic means can be effected only when the fast idle means has been released from engagement with the throttle valve or, actually, the throttle lever. Therefore, if an engine incorporating the conventional fast idle means is left in warming-up operation without occasionally stepping on the accelerator pedal, the idling speed gradually increases in accordance with warming up of the engine and finally it operates at a very high idling speed which causes very high engine noise and fuel consumption. Therefore, in the case of an engine incorporating such a fast idle means, the driver is required to occasionally step on the accelerator pedal in the course of warming up operation so as to occasionally release the fast idle means thereby allowing for resetting of the fast idle means step by step in accordance with gradual deformation of the bimetallic means.

In automobile engines, if the throttle valve is abruptly closed to the idle position by full release of the accelerator pedal while the engine is running at a relatively high speed, a high manifold vacuum is caused in the intake system of the engine whereby liquid fuel droplets attached to the inner wall surface of the intake passage violently evaporate and a large amount of fuel is drawn into the cylinders of the engine. On the other hand, since the flow of intake air is reduced by the closing of the throttle valve, the air/fuel ratio becomes too low, or too rich, thereby causing misfiring and delivery of a large amount of uncombusted components in the exhaust system. This causes the problem of air contamination and, furthermore, when secondary air is injected into the exhaust system for the purpose of purifying exhaust gases, combustion of uncombusted component occurs in the exhaust system and causes so-called afterfire. In order to avoid high emission of uncombusted components or occurrence of afterfire during deceleration in high-speed running, it has been proposed to incorporate a throttle control means such as throttle positioner, throttle opener, dashpot, etc., which temporarily increases the idle opening when the throttle valve has been abruptly closed after a long-lasting full open condition.

SUMMARY OF THE INVENTION

The primary object of the present invention is to provide an idle speed controller for internal combustion engines which controls idling rotational speed of the engine at a substantially constant value regardless of changes of engine idling load.

In accordance with the present invention, the above-mentioned object is accomplished by providing an idle speed controller for an internal combustion engine having a throttle valve, comprising an idle positioner for setting idle position of said throttle valve, an actuator for biasing said idle positioner in the directions of opening and closing said throttle valve, a rotational speed sensor for detecting a signal which represents engine speed, and an operational control means for operating said actuator depending on rotational speed information received from said rotational speed sensor. By this arrangement, the idle position or idle opening of the throttle valve is adjusted by a feedback control means depending upon engine rotational speed so as to maintain a substantially constant rotational speed of the engine regardless of the load imposed on the engine.

As the signal which represents engine speed, an ignition signal in the engine ignition system, an electrical output signal generated by an electric pulse generating means incorporated in rotary portions of the engine such as the crankshaft, camshaft, etc. or other similar signals may be employed. The actuator may conveniently be a diaphragm actuator adapted to be actuated by a vacuum modified from the intake vacuum in accordance with the rotational speed of the engine by employing a vacuum modulation valve or the like.

Another object of the present invention is to provide an idle speed controller such as mentioned above which further comprises a thermal sensor for detecting warming-up condition of the engine by measuring the temperature of engine cooling water, lubrication oil, engine housing, etc. wherein said operational control means also responds to engine warming up information received from said thermal sensor for operating said actuator so that the idle position of the throttle valve is determined depending upon rotational speed of the engine and modified by engine warming-up condition. By this arrangement, the conventional fast idle means which requires occasional stepping on of the accelerator pedal during warming-up operation can be abolished.

Still another object of the present invention is to provide an idle speed controller having the abovementioned control system for controlling idle position of the throttle valve depending upon rotational speed of the engine and further incorporating a vacuum sensor for detecting intake manifold vacuum, wherein said operational control means is modified so as to operate said actuator depending upon rotational speed information received from said rotational speed sensor as well as manifold vacuum information received from said vacuum sensor, whereby the idle position of the throttle valve is controlled so as to maintain a substantially constant rotational speed of the engine while it is temporarily biased to an increased idle opening when said vacuum sensor detects an intake manifold vacuum larger than a predetermined value. By employing an idle speed controller of this type, the abovementioned conventional throttle positioner, throttle opener, dashpot, or the like can be omitted.

BRIEF DESCRIPTION OF THE DRAWING

The present invention will become more fully understood from the detailed description given hereinbelow and the accompanying drawings which are given by way of illustration only and are thus not limitative of the present invention and wherein.

DESCRIPTION OF THE PREFERRED EMBODIMENT

Figure 1:
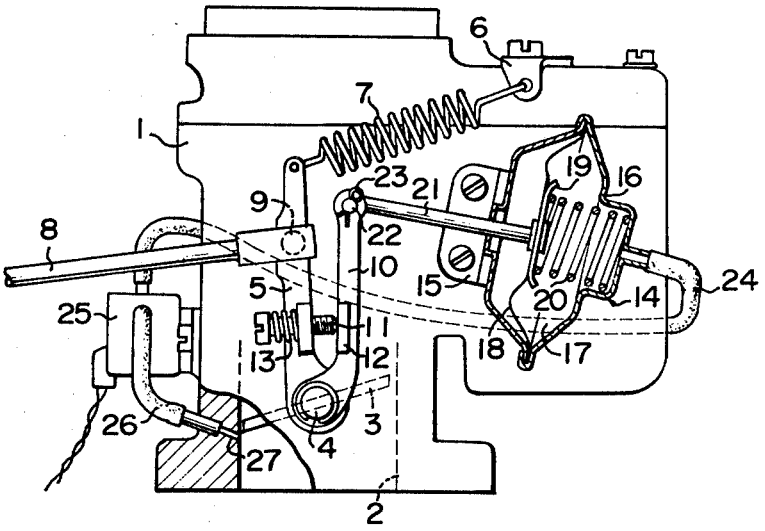
FIG. 1 is a side view of a carburetor incorporating an embodiment of an idle speed controller of the present invention.

Turning now to FIG. 1, the body of a carburetor generally designated by reference numeral 1 has an intake passage 2 formed therein, in which is provided a disc-like throttle valve 3. The throttle valve is supported by a rotary throttle shaft 4 and is opened or closed by rotational operation of the throttle shaft. One end of the throttle shaft 4 projects outside from the body 1 and supports a throttle lever 5 mounted thereto. The thorttle shaft 4 is constantly biased to rotate clockwise as seen in the figure or to close the throttle valve by an expanding coil spring 7 mounted between a free end portion of the throttle lever and a lug member 6 mounted to the body 1. An acceleration control rod 8 engages the throttle lever adjacent its free end by a ball joint as shown in the figure. The above-explained structure is a conventional structure for opening or closing the throttle valve incorporated in usual carburetors.

In accordance with the present invention, a movable arm 10 is rotatably mounted to an end portion of the throttle shaft 4. The arm 10 has a stopped lug portion 12 at a middle portion thereof which is adapted to be abutted by an adjust screw 11 supported by the throttle lever 5. A compression coil spring 13 is provided for maintaining the adjusted position of the adjust screw 11.

The movable arm 10 is adjusted of its rotary position around the throttle shaft 4 by a diaphragm actuator 14 which as a casing 16 mounted to the carburetor body 1 by a bracket 15, a diaphragm 18 defining a diaphragm chamber 17 on one side thereof, a dish element 19 combined with the diaphragm, a compression coil spring 20 engaging said dish element at one end thereof so as to resiliently drive the diaphragm leftward in the figure and a rod 21 supported by said diaphragm at one end thereof and extended outside of said casing to be pivotably connected with a free end portion of the arm 10 by a pin 22 and a spring pin 23. The compression coil spring 20 operates to drive the arm 10 anti-clockwise or in the direction of opening the throttle valve by way of the diaphragm 18 and the rod 21. This driving force applied by the compression coil spring 20 is designed to be stronger than the driving force applied by the expansion coil spring 7 to drive the throttle valve clockwise in the figure or in the direction for closing the throttle valve in a manner such that when the diaphragm actuator is not supplied with any operating vacuum the force of the spring 20 overcomes the force of the spring 7 thereby establishing a relatively large idle opening for the throttle valve.

The diaphragm chamber 17 of the diaphragm actuator 14 is connected with a vacuum modulator 25 by a tube 24. The vacuum modulator is in turn connected with an intake vacuum take-out port 27 by means of a tube 26, said port being provided in the carburetor body to open to the intake passage 2.

Figure 2:
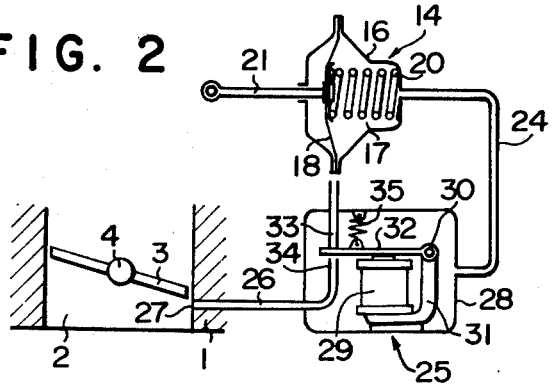
FIG. 2 is a diagrammatical sectional view showing a vacuum control system incorporated in the idle speed controller of the present invention.

As shown in FIG. 2, the vacuum modulator 25 comprises a housing 28 in which are mounted a solenoid 29, an armature 32 pivotably supported by a bracket 31 by a pivot pin 30, and two opposing nozzles 33 and 34 adapted to be controlled by said armature which operates as a flap valve. The nozzle 33 is opened to the atmosphere at the other end thereof, while the nozzle 34 is connected with the intake vacuum port 27 by way of the tube 26. The internal space of the housing 28 is connected with the diaphragm chamber 17 of the diaphragm actuator 14 by way of the tube 24. The armature or flapper nozzle 32 is biased upward in the figure by an expansion coil spring 35 so that it closes the nozzle 33 when the solenoid 29 is not energized. By this arrangement, when the solenoid 29 is not energized, the internal space of the housing 28 is prevented from communication with the atmosphere through the nozzle 33 and is substantially connected with the vacuum port 27 thereby transmitting intake vacuum to the diaphragm chamber 17 of the actuator 14, whereas when the solenoid 29 is energized, the internal space of the housing 28 is prevented from communication with the vacuum port 27 through the nozzle 34 and is opened to the atmosphere through the nozzle 33 thereby transmitting atmospheric pressure to the diaphragm chamber 17 of the actuator 14.

Figure 3:
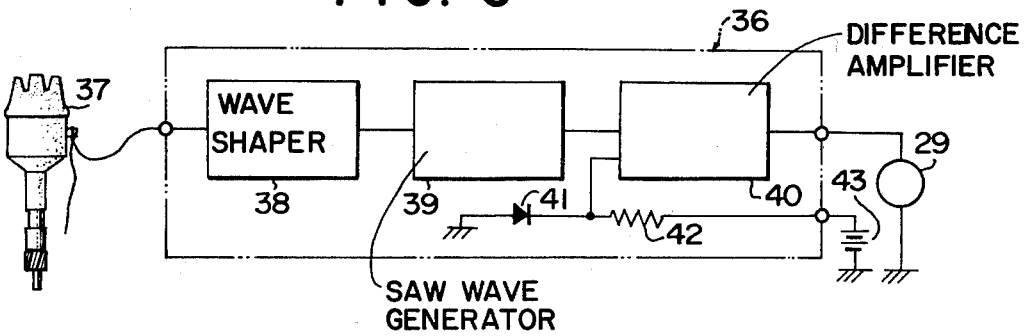
FIG. 3 is a diagram showing an electrical control system incorporated in the idle speed controller of the present invention.

The operation of the solenoid 29 is controlled by an electronic control circuit 36 as shown in FIG. 3. The electronic control circuit receives an ignition signal from the primary circuit of the distributor 37. The electronic control circuit 26 comprises a wave-shaping circuit 38, a saw-wave generating circuit 39, a difference amplifier 40, a Zener diode 41 and a resistor 42. 43 designates a power source for the electronic control circuit 36 and may be the battery for the engine.

Figure 4:
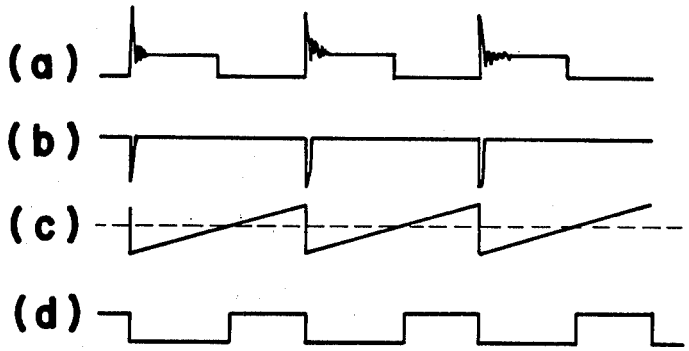
FIG. 4 is a set of graphs explaining the operation of the idle speed controller of the present invention.

The idle speed controller shown in FIGS. 1–3 operates as follows:

FIG. 4(*a*) shows the ignition signal taken from the primary circuit of the distributor 37. This signal is supplied to the wave-shaping circuit 38 and is processed therein to produce a wave signal as shown in FIG. 4(*b*), which is a kind of trigger signal. This signal is then supplied to the saw-wave generating circuit 39 which generates a saw-wave signal as shown in FIG. 4(*c*). This is a signal which starts to increase from zero or a basic value upon receipt of a negative pulse in the trigger signal until the next negative pulse is dispatched, whereupon the signal at once returns to zero or the basic value and then again begins to increase. Such a signal is readily obtained by employing an integrating circuit. The saw-wave signal is supplied to the difference amplifier 40 which is also supplied with a constant voltage generated by the battery 43, Zener diode 41 and resistor 42. The difference amplifier 40 compares the saw-wave signal with said constant voltage and generates a pulse signal which is OFF when the saw wave signal is lower than said constant voltage and is ON when the saw wave signal is higher than said constant voltage, as shown in FIG. 4(*d*). This pulse signal is supplied to the solenoid 29 of the vacuum modulator 25.

The solenoid 29 is energized while said pulse signal is ON and draws the flapper valve 32 downwards in the figure, thereby closing the nozzle 34 while it opens the nozzle 33. When the pulse signal is OFF, the solenid 29 is de-energized, whereby the flapper valve 32 is biased upwards in the figure by the expansion coil spring 35 thereby closing the nozzle 33 while it opens the nozzle 34. When the solenoid 29 is cyclically energized and de-energized by the pulse signal as shown in FIG. 4(*d*) having the same frequency as the ignition effected in the engine, opening of the atmospheric pressure nozzle 33 and the vacuum nozzle 34 is alternated at a relatively high frequency, whereby the pressure in the housing 28 becomes a level intermediate between atmospheric pressure and the intake vacuum of the engine, said intermediate pressure being determined by the ratio of ON duration to OFF duration in the pulse signal. In more detail, when the duty ratio becomes larger, the vacuum in the housing 28 becomes smaller, while on the contrary when the duty ratio becomes smaller, the vacuum in the housing 28 becomes larger.

The vacuum generated in the housing 28 is transmitted to the diaphragm chamber 17 of the diaphragm actuator 14 by the tube 24 and biases the diaphragm 18 rightwards in the figure against the reaction of the compression coil spring 20. The displacement of the diaphragm is substantially proportional to the absolute value of the vacuum supplied to the diaphragm chamber 17.

When the absolute value of the vacuum supplied to the diaphragm chamber 17 is small, the diaphragm 18 is biased leftwards in the figure by the spring force of the compression coil spring 20 thereby driving the arm 10 by way of the rod 21 so as to rotate the arm 10 anticlockwise in the figure around the throttle shaft 4 so that the lug 12 is driven toward the adjust screw 11, thereby establishing a relatively large idle opening for the throttle valve 3. As the absolute value of the vacuum supplied to the diaphragm chamber 17 increases, the diaphragm 18 is gradually driven rightward in the figure against the spring force of the compression coil spring 20 thereby retracting the arm 10 or the lug 12 from the adjust screw 11, thereby providing gradually reduced idle opening for the throttle valve. When the vacuum in the diaphragm chamber 17 becomes substantially the same as the vacuum in the intake passage 2, the arm 10 or the lug 12 moves to a position which provides the minimum idle opening for the throttle valve wherein it is substantially fully closed.

In the aforementioned manner, the idle position for the throttle valve is controlled depending on the rotational speed of the engine in a manner of feedback control.

Figure 5:
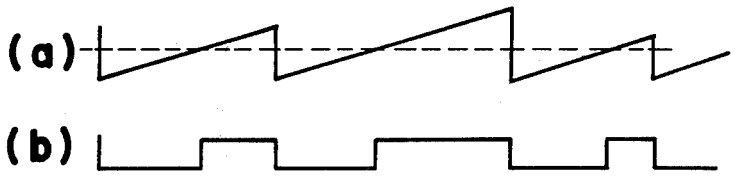
FIG. 5 is a view similar to FIG. 4 explaining variations effected in the operation of the idle speed controller of the present invention.

FIG. 5 shows the way in which the saw wave signal and the pulse signal change in accordance with the rotational speed of the engine. In FIG. 5, signals (a) and (b) correspond to signals (c) and (d) in FIG. 4. Let us assume that the first wave and pulse in FIG. 5 are of the standard condition wherein the engine is idling at a standard speed. If the load imposed on the engine has increased due to an increase of the generator load, operation of an air conditioner, etc., idling speed of the engine will lower. If idling speed has lowered, period of the ignition signal taken from the distributor becomes longer, like the second saw wave in FIG. 5. This longer saw wave causes a longer ON duration in the pulse signal as in the second pulse of FIG. 5 thereby increasing the duty ratio of the pulse signal. If the duty ratio increases, the vacuum in the housing 28 is reduced thereby supplying a smaller vacuum to the diaphragm chamber 17 of the actuator 14, thereby causing a leftward movement of the diaphragm 18 which advances the idle position for the throttle valve toward a larger opening. Thus, engine output power is increased so as to compensate for the increase of load imposed upon the engine. On the other hand, when the load imposed on the engine operating in idling condition is reduced, idle speed of the engine increases and the period of the pulses in the ignition signal shortens. In this condition, the saw wave shortens and the duty ratio of the pulse signal is reduced like the third wave and pulse in FIG. 5. Therefore, the vacuum in the housing 28 increases thereby causing a rightward movement of the diaphragm 18 thereby retracting the lug 12 toward a position which establishes a smaller idle opening. Therefore, engine output power is reduced so as to meet with the reduced load imposed upon the engine.

Figure 6:
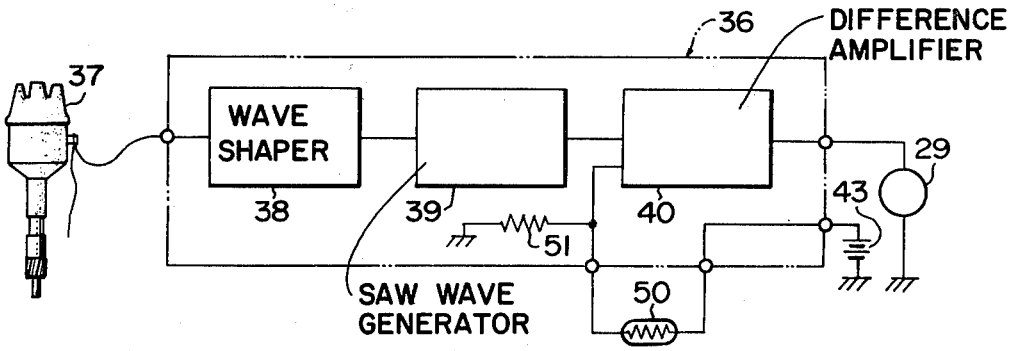
FIG. 6 is a diagram similar to FIG. 3 showing a modification incorporated in the electrical control system.

When the engine is warmed up starting from the cold state, it is desirable that idling speed of the engine is a little higher than that in the warmed-up condition. The fast idle means is conventionally employed to temporarily increase idle speed during warming-up operation. In accordance with the present invention, such a temporary increase of idle speed for warming-up operation is readily obtained without employing the conventional fast idle means. FIG. 6 shows a modification of the electric control circuit 36 for obtaining the above-mentioned temporary increase in idle speed. In FIG. 6, 50 designates a thermistor adapted to detect a temperature which represents the temperature of the engine such as the temperature of the cooling water, etc. 51 is a resistor for adjusting the performance of the thermistor.

Figure 7:
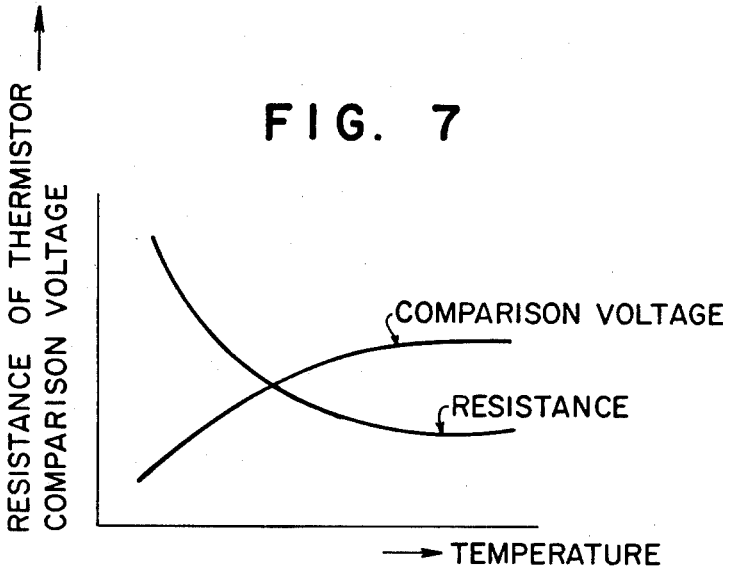
FIG. 7 is a graph showing the performance of a thermistor.
Figure 8:
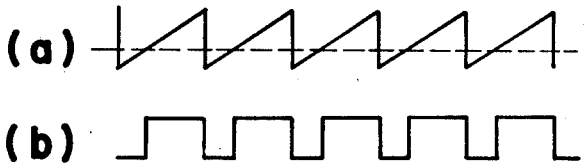
FIG. 8 is a graph similar to FIG. 5 explaining another modification of operation of the idle speed controller of the present invention.

FIG. 7 shows general performance of the thermistor 50. The resistance of a thermistor generally reduces as the temperature thereof increases in a manner as shown in FIG. 7. Therefore, the comparison voltage supplied to the difference amplifier 40 increases as the temperature of the thermistor increases in a manner shown in FIG. 7. In more detail, the comparison voltage supplied to the difference amplifier 40 is relatively low when the engine is in the cold state and the comparison voltage gradually increases as the engine is warmed up. Therefore, when the engine is idling in the cold state, the saw-wave signal is compared with a relatively low comparison voltage, whereby a pulse signal having a relatively high duty ratio is generated as shown in FIG. 8. The high duty ratio produces a small vacuum in the housing 28 of the vacuum modulator 25 and causes a leftward biasing of the diaphragm 18 in the actuator 14 thereby advancing the lug 12 of the arm 10 toward a position for establishing a larger idle opening for the throttle valve.

As the engine is gradually warmed up, the thermistor 50 is correspondingly warmed up, thereby reducing its resistance, while the comparison voltage supplied to the difference amplifier 40 is correspondingly raised. Consequently, the duty ratio of the pulse output from the difference amplifier 40 is reduced and idle speed of the engine is correspondingly reduced. When the engine has been completely warmed up, idle speed of the engine is automatically adjusted to the standard value.

Figure 9:
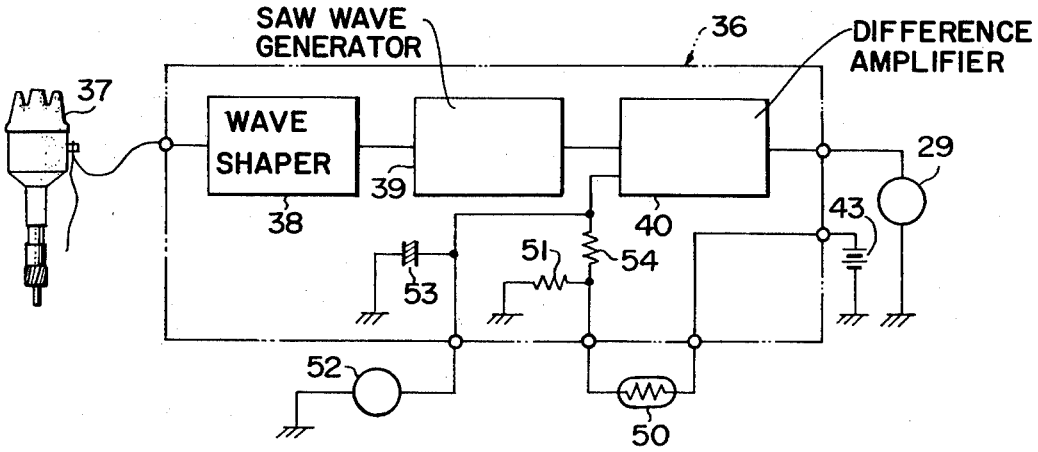
FIG. 9 is a view similar to FIGS. 3 and 6 showing still another modification of the electrical control system.

FIG. 9 shows still another modification of the electric control circuit 36 which further incorporates a means for preventing misfiring during deceleration of the automobile. In FIG. 9, 52 designates a pressure switch which is closed when intake manifold vacuum has increased beyond a predetermined value. 53 is a condenser and 54 is a resistor. In this arrangement, when the pressure switch 52 is closed, the comparison voltage supplied to the difference amplifier 40 becomes zero. In this condition, therefore, the idle opening for the throttle valve is made the maximum. This occurs when an automobile is decelerated when running at a relatively high speed with abrupt full closing of the throttle valve thereby causing a very high vacuum in the intake passage and manifold of the engine. When the engine has been decelerated so that intake manifold vacuum reduces below a predetermined value, the pressure switch 52 is opened and a normal comparison voltage is again supplied to the difference amplifier 40. On this occasion, the condenser 53 operates so as to gradually return the comparison voltage from zero to the normal level. By this arrangement, the throttle valve is maintained at a small opening rather than the substantially closed idle opening during high-speed deceleration of the automobile, thereby avoiding generation of over-rich fuel-air mixture due to a very high intake vacuum caused by high-speed deceleration, whereby troubles such as misfiring, afterburning, and high emission of harmful and uncombusted components are effectively avoided.

Although the invention has been shown and described with respect to some preferred embodiments thereof, it should be understood by those skilled in the art that various changes and omissions of the form and detail thereof may be made therein without departing from the scope of the invention.

I claim:

1. An idle speed controller for an internal combustion engine having a throttle valve, comprising an idle positioner for setting the idle position of said throttle valve, a diaphragm actuator for biasing said idle positioner in the directions of opening and closing said throttle valve, a rotational speed sensor for detecting a signal which represents engine speed, and an operational control means which operates said diaphragm actuator depending upon rotational information received from said rotational speed sensor, said operational control means comprising:

an intake vacuum take-out port;

a vacuum modulator, which modulates intake vacuum taken from said port and supplies a modulated vacuum to said diaphragm actuator, comprising a housing, a solenoid mounted in said housing, an armature-flapper valve adapted to be actuated by said solenoid, a first nozzle adapted to be controlled by said flapper valve to selectively communicate the internal space of said housing to the atmosphere, a second nozzle adapted to be controlled by said flapper valve to selectively communicate the internal space of said housing to said manifold vacuum take-out port, and a conduit means which communicates the internal space of said housing to said diaphragm actuator;

and an electric control circuit for controlling said vacuum modulator in accordance with said rotational speed information, which generates an electric pulse ouput for engergizing said solenoid, and which comprises a wave-shaping circuit which processes said rotational speed information to generate a trigger signal having frequency proportional to the rotational speed of the engine, a saw-wave generator for generating saw-waves each being triggered by said trigger signal, a comparison voltage generating circuit for generating a comparison voltage, a pressure switch for detecting intake vacuum incorporated in said comparison voltage generating circuit so as to substantially lower said comparison voltage when intake vacuum has increased beyond a predetermined value, and a difference amplifier which compares said saw-waves and said comparison voltage and generates said pulse output having a duty ratio which is the ratio of a first duration wherein said saw-wave is higher than said comparison voltage to a second duration wherein said saw-wave is lower than said comparison voltage.

2. The idle speed controller of claim 1, wherein said electric control circuit further comprises a thermistor for detecting engine temperature, said thermistor being incorporated in said comparison voltage generating circuit so as to modify said comparison voltage in a manner such that said comparison voltage is raised as engine temperature rises.

3. The idle speed controller of claim 1, wherein said comparison voltage generating circuit further comprises a condenser which provides a damping effect at the time when said pressure switch is restored to its normal state wherein it detects intake vacuum smaller than said predetermined value.

* * * * *